US005224074A

United States Patent [19]

Sullivan

[11] Patent Number: 5,224,074

[45] Date of Patent: Jun. 29, 1993

[54] SONOBUOY FOR FORMING VIRTUAL VERTICAL SENSING ARRAYS

[75] Inventor: Edmund J. Sullivan, Portsmouth, R.I.

[73] Assignee: The United States of America as represented by the Secretary of the Navy, Washington, D.C.

[21] Appl. No.: 910,053

[22] Filed: Jul. 8, 1992

[51] Int. Cl.[5] ..... H04B 1/59

[52] U.S. Cl. ..... 367/3; 367/4; 367/16; 367/141; 441/21

[58] Field of Search ..... 367/3-6, 367/16, 18, 20, 153, 154, 141; 441/1, 2, 7, 9, 10, 21, 28, 29, 30, 33

[56] References Cited

U.S. PATENT DOCUMENTS

| | | | |
|---|---|---|---|
| 3,126,559 | 3/1964 | Alexander | 441/2 |
| 3,489,994 | 1/1970 | Massa | 367/154 |
| 3,671,928 | 6/1972 | Schultz | 367/2 |
| 3,818,523 | 6/1974 | Stillman, Jr. | 367/3 |
| 4,093,934 | 6/1978 | Urick et al. | 367/2 |
| 5,040,157 | 8/1991 | Roderick et al. | 367/3 X |

*Primary Examiner*—J. Woodrow Eldred

*Attorney, Agent, or Firm*—Michael J. McGowan; Prithvi C. Lall; Michael F. Oglo

[57] ABSTRACT

A sonobuoy for forming a plurality of virtual vertical arrays, the sonobuoy having means for receiving and expelling water to cause said sonobuoy automatically to descend and rise in a water environment, whereby to form sequentially a plurality of virtual vertical arrays.

12 Claims, 3 Drawing Sheets

SONOBUOY FOR FORMING VIRTUAL VERTICAL SENSING ARRAYS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to underwater acoustic sensing devices and, more particularly, to an expendable sonobuoy for forming virtual vertical sensing arrays.

(2) Description of the Prior Art

It is known to detect the location of an underwater object emitting sound, by utilization of a linear array of sound sensing devices, such as hydrophones. By recognition of the intensity of the sound, and the angle from which the sound is coming, there is computed a location for the sound source which, in military application, may be an underwater target, such as a submarine and in non-military applications may be a large animal, such as a whale, or a school of fish, or a sunken ship or other derelict. In general, the longer the array, the more accurate is the determination of the target location, particularly if the target is emitting a relatively low-frequency noise.

It is further known to extend the effective aperture (length) of an array of hydrophones by exploiting movement of the array during an observation period such that the effective aperture is equivalent to that of a longer, fully populated physical array having a length equal to the distance travelled by the moving array during the observation period. In U.S. Pat. No. 4,930,111, issued May 29, 1990, in the names of Edmund J. Sullivan and Stergios Stergiopoulos, there is disclosed a system utilizing a towed array of hydrophones, in which the effective length of the array is increased beyond the physical length of the array, to provide better definition of the target location.

In U.S. Pat. No. 5,040,157, issued Aug. 13, 1991, in the names of William I. Roderick and William A. Von Winkle, there is disclosed an expendable sonobuoy weighted to free-fall through the water, thereby forming a very long effective aperture, facilitating a long virtual vertical array. Acoustic field, temperature and depth information is transmitted from the sonobuoy to a host platform, such as a surface vessel, or an instrumented buoy which is in radio contact with an aircraft or surface vessel, via a communication line connecting the sonobuoy to the host platform. The sonobuoy transmits at preselected depth points along the effective aperture established by the free-fall of the sonobuoy to effectuate a very long virtual vertical array. The information signalled from the sonobuoy to the host platform is correlated to determine the range, depth and direction of the target. After the inputs from the virtual vertical array are accumulated, the communication line may be disconnected, the sonobuoy being thereby expended. The expendability of the sonobuoy is marginally acceptable in practice inasmuch as only a relatively inexpensive sonobuoy is required to generate a very large virtual vertical sensing array.

A difficulty which arises relative to use of the aforementioned sonobuoy is the fact that the sonobuoy is capable of only a single pass through the virtual vertical aperture. Given aberrations in the ocean underwater environment, low signal-to-noise ratio and the fact that targets may well be engaged in evasive maneuvers, it may be necessary in a given situation to expend more than a single sonobuoy, raising the cost, and increasing the required storage space for multiple sonobuoys on the host platform or other carrier.

Accordingly, it would be desirable to have available a sonobuoy having the sensing and signalling capabilities of the sonobuoy of U.S. Pat. No. 5,040,157, but, in addition, having the capability of generating a plurality of sequential virtual vertical arrays, such that one sonobuoy may fill the role of a plurality of the prior art devices.

SUMMARY OF THE INVENTION

It is, therefore, an object of the present invention to provide a sonobuoy for forming sequentially a plurality of virtual vertical arrays having lengths for greater than the length of the physical array employed.

It is a further object of the invention to provide such a sonobuoy of controllable buoyancy.

With the above and other objects in view, as will hereinafter appear, a feature of the present invention is the provision of a sonobuoy for forming a plurality of virtual vertical arrays, the sonobuoy comprising a housing, hydrophone means mounted on the housing, a cable attached at one end to the housing and at a second end adapted for attachment to a host platform, the hydrophone means being adapted to transmit through the cable to the host platform signals indicative of the acoustic field detected by the hydrophone means, the housing having therein a compartment and means for receiving water from outside the housing to flood the compartment so as to cause the sonobuoy to descend, thereby forming a first virtual vertical array, and means in the housing for expelling water from the compartment to cause the sonobuoy to rise, thereby forming a second virtual vertical array.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
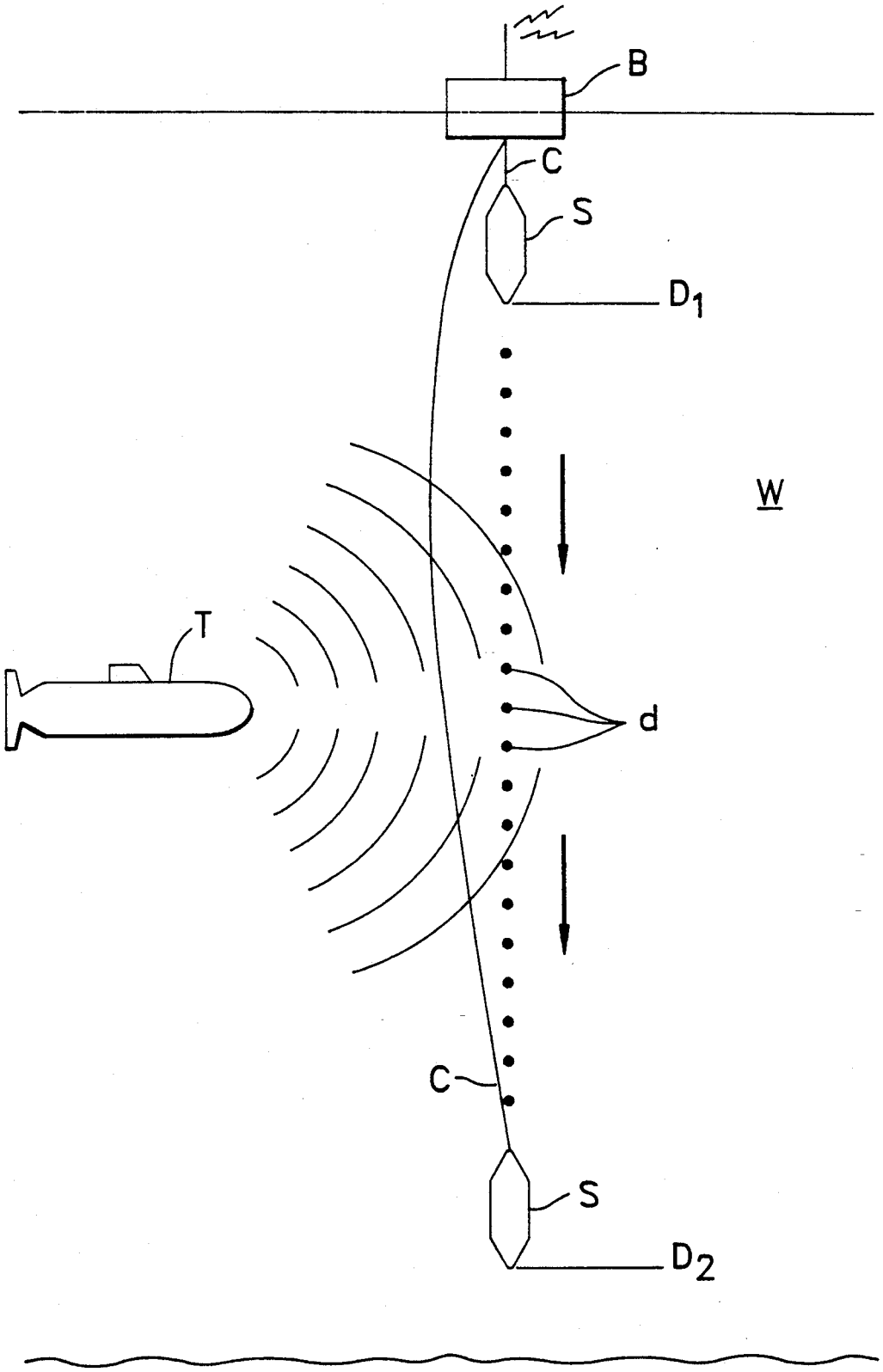
FIG. 1 PRIOR ART
FIG. 1 is a schematic illustration of a prior art system in which there is used as a component thereof a virtual vertical array.

In FIG. 1, there is shown a flotation buoy B adapted to receive signals and transmit signals to a distant receiver from a sonobuoy S. The sonobuoy S, having thereon at least one omnidirectional hydrophone, and the flotation buoy B, are released into the water W from a ship or aircraft. The sonobuoy S maintains communication with the flotation buoy B by way of a cable C, of either electrical or fiber optic construction, interconnecting the sonobuoy S and flotation buoy B. The sonobuoy S is sufficiently weighted to exhibit a vertical freefall through the water W.

As the sonobuoy S free-falls from a shallow depth D1 to a deep depth D2, a large virtual aperture is formed between the depths D1 and D2. At numerous depth points d, or continuously if desired, acoustic field, temperature and depth information is transmitted from the sonobuoy S to the flotation buoy B and from the flotation buoy B to a distant receiver, typically an aircraft or surface vessel. The information at the depth points d comprises the inputs of a virtual vertical array between the depths, D1 and D2. The information supplied by the sonobuoy S is typically processed on board the distant receiver (not shown) and, as described in the aforementioned U.S. Pat. No. 5,040,157, forms the basis of a predicted location of an underwater target T.

Figure 2:
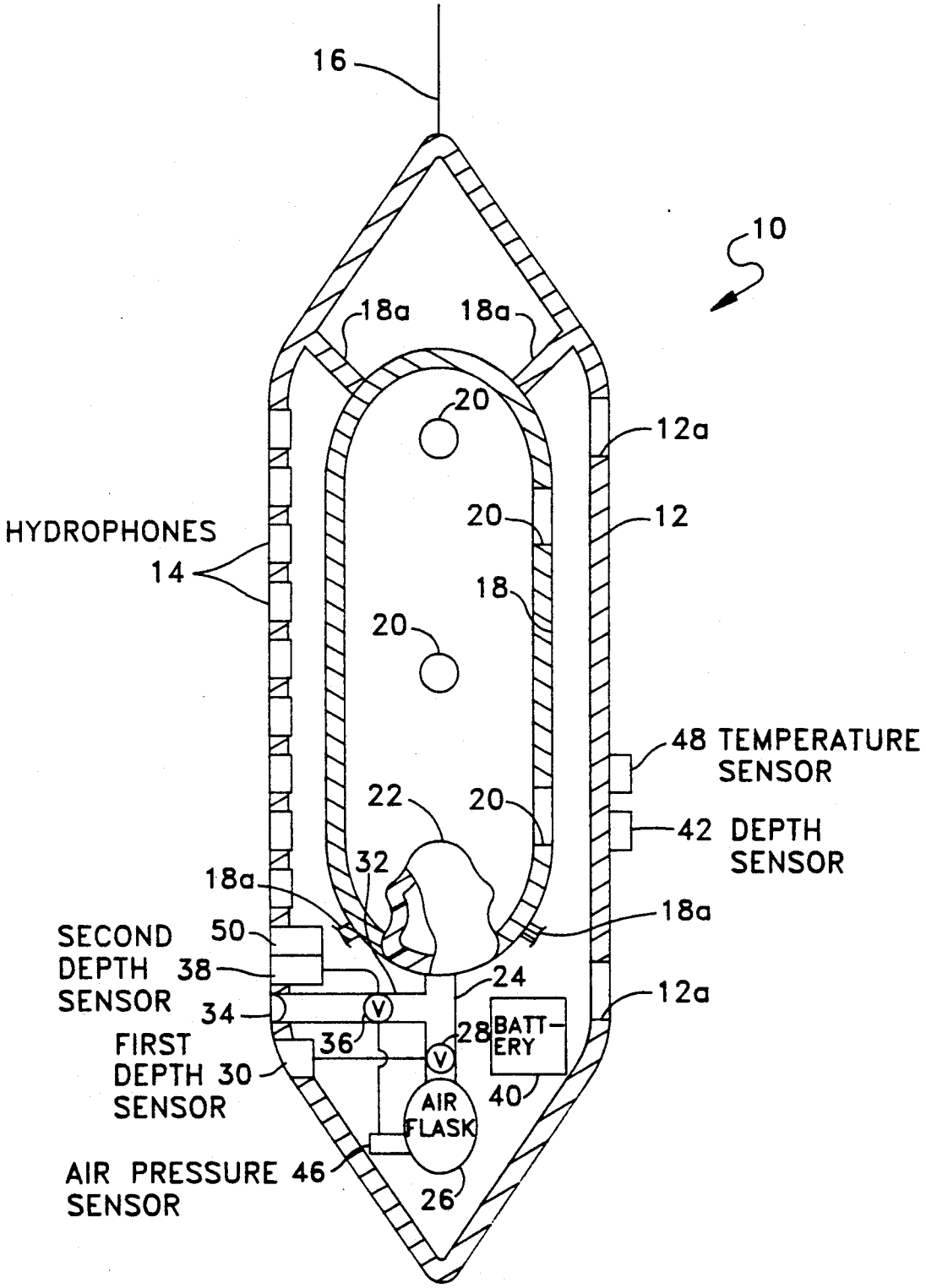
FIG. 2 is a sectional view, partly diagrammatic, of a sonobuoy illustrative of an embodiment of the invention.

Referring to FIG. 2, it will be seen that the illustrative sonobuoy 10, capable of defining a plurality of virtual vertical arrays, comprises a metal housing 12 having mounted therethrough hydrophone means 14 comprising one or more uniformly spaced hydrophones mounted in the wall of housing 12, and a plurality of apertures 12*a* passing through the wall of housing 12. Hydrophone means 14 are in communication (FIG. 3) with a cable 16 fixed at one end to housing 12 (FIG. 2) and at the other end adapted to be fixed to a flotation buoy of the type shown in FIG. 1.

The housing 12 is provided with a metal chamber 18 and means, such as apertures 20 in the wall of chamber 18, for admitting water from outside sonobuoy 10 through apertures 12*a* and into chamber 18 to increase the weight of the sonobuoy. Disposed within chamber 18 is an expandable elastomeric bladder 22 adapted, upon full expansion, to substantially fill chamber 18. Chamber 18 is affixed by struts 18*a* to housing 12.

The mouth of bladder 22 is fixed on a metal air pipe 24 extending to a compressed air flask 26. An air valve 28 is disposed in air pipe 24 and operative in response to a first depth sensor 30 to open and close air pipe 24 to provide communication between air flask 26 and bladder 22.

A metal exhaust pipe 32 extends from a location between bladder 22 and air valve 28 on air pipe 24 to an exhaust opening 34 in the side of housing 12 (FIG. 2). An exhaust valve 36 is disposed in exhaust pipe 32 and operative in response to a second depth sensor 38 to open and close exhaust pipe 32 to provide communication between bladder 22 and the outside of housing 12.

Figure 3:
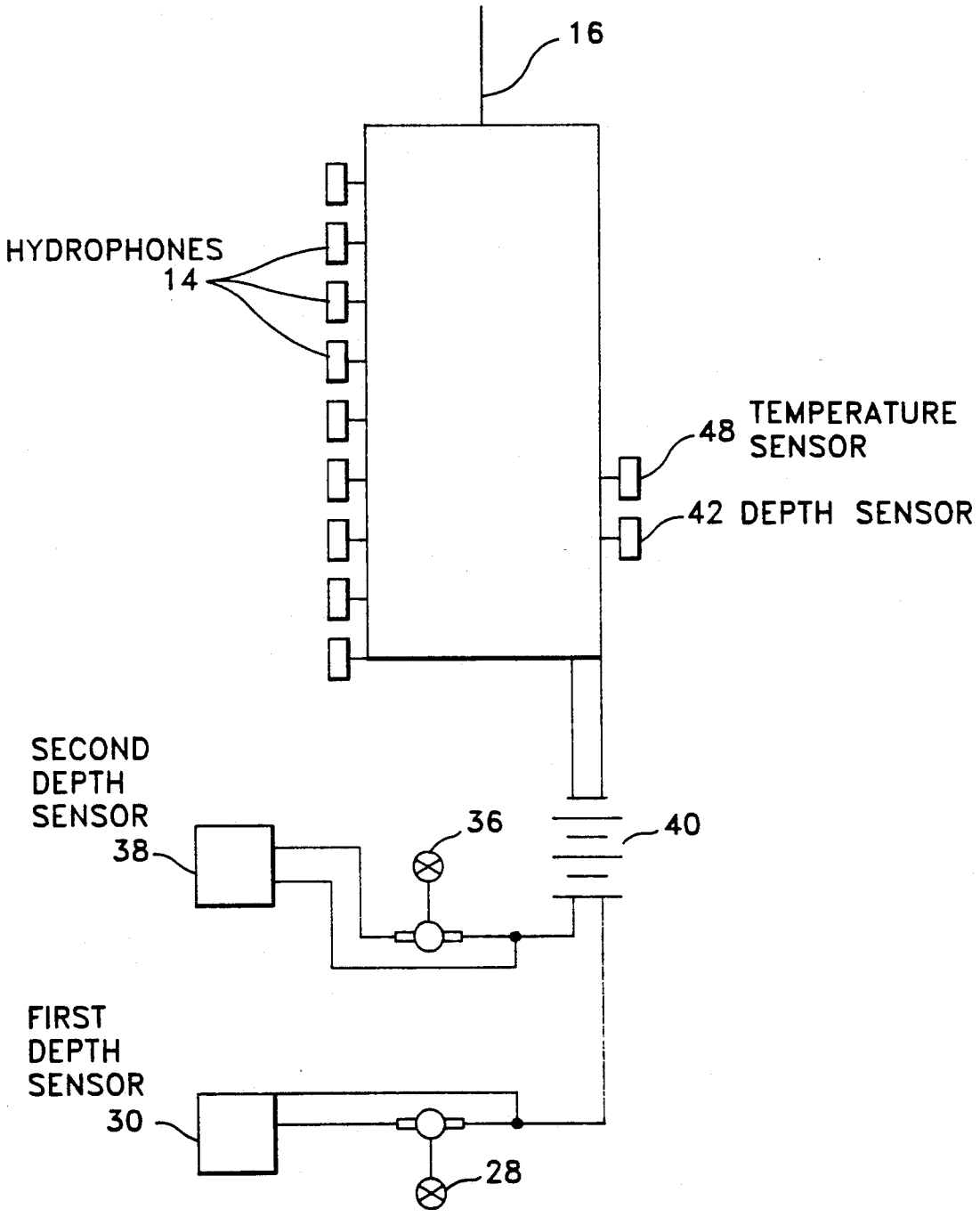

Disposed in housing 12 is a battery 40 which provides power for transmission of signals from hydrophone means 14 to flotation buoy B and for operation of depth sensors 30, 38 and motors driving their associated valves 28, 36 (FIG. 3). Power may alternatively, or in part, be provided from the flotation buoy. Optionally, there may be mounted on housing 12 one or more additional depth sensors 42 powered by battery 40, for transmitting to the flotation buoy B via cable 16 signals as to the depth of the sonobuoy.

While it is expected that in many instances, particularly in military usage, the sonobuoy of the present invention will be used as an expendable device, it is probable that in whale and fish-tracking operations, as well as in other underwater research projects, it will be advantageous to be able to retrieve the sonobuoy for reuse. To facilitate retrieval of the sonobuoy, there may be disposed in housing 12 in communication with the air flask 26, an air pressure sensor 46 which senses the pressure remaining in air flask 26 and, when the pressure in flask 26 indicates that the sonobuoy is on its last trip upward, operates to override the depth sensor 38 and keep the exhaust valve 36 closed, regardless of shallow depth. In this embodiment, when the sonobuoy reaches the surface the last time, the sonobuoy remains floating on the surface of the water. The flotation buoy may be programmed to dispatch a "pick up" signal to the host platform which can then proceed to the signalling flotation buoy and retrieve the sonobuoy and flotation buoy.

Optionally, housing 12 may be provided with one or more temperature sensors 48, powered by battery 40. Such facility is helpful in use of the sonobuoy for measuring temperature gradients in the ocean and/or other large bodies of water.

It will be apparent that the sonobuoy of the present invention lends itself to additional specialized endeavors, such as, for example, measuring toxicity at various levels in and around ocean dump sites, and detecting the presence of oil or other spilled cargoes resulting from accidents at sea.

In a typical military use, a plurality of sonobuoys 10 are dropped from an aircraft, the sonobuoys each being tethered to its flotation buoy by its cable 16. In the drop state, air valve 28 is closed, exhaust valve 36, which is a one-way valve permitting flow from inboard to outboard, is "open"; and bladder 22 which, as seen in FIG. 2, is vacuous is substantially collapsed.

Chamber 18 receives water through the apertures 20, adding weight to the sonobuoy, which starts sinking below the surface. As chamber 18 fills with water, the sonobuoy free-falls, defining a virtual vertical aperture through the water. As the sonobuoy falls, the hydrophone means send messages relative to any sensed acoustic field to the flotation buoy B, which, in turn, transmits the information to a host platform. If attached to housing 12, depth sensors 42 and temperature sensors 48 dispatch signals to the flotation buoy. As the signals from the hydrophone means are sent to the flotation buoy, there is defined a first virtual vertical array of possibly immense proportions, i.e., several hundred feet or more, virtually impossible to obtain in physical arrays.

Upon reaching a preset deep depth, the first depth sensor 30 signals air valve 28 to open, permitting air to fill and expand bladder 22 to force water from chamber 18 through the apertures 20. At a given pressure in bladder 22, air valve 28 closes. As the water exits chamber 18, buoy 10 lightens in weight and rises toward the surface. As the buoy rises through a second virtual vertical aperture the hydrophone means dispatch acoustic field signals, establishing a second virtual vertical array of very long length and therefore of great accuracy in pinpointing the location of the target T.

Upon reaching a preset shallow depth, the second depth sensor 38 releases one-way exhaust valve 36, permitting air to flow from bladder 22, through exhaust pipe 32 and out through exhaust opening 34. Again, sonobuoy 10 starts a downward trip, and continues alternately falling and rising, each time establishing a virtual vertical array. When air flask 26 is spent, the sonobuoy sinks, taking with it the flotation buoy B.

As noted above, in long-lasting research projects, buoy 10 may be programmed to remain on the surface for preset periods of time before the downward trips, making a round trip, for example, every hour, or the like, to track migration of large living creatures, or schools of fish. A timer device 50 may be used to delay release of exhaust valve 36, so that the sonobuoy floats for a preselected period of time before starting another descent. In such instances, the provision of solar panels (not shown) will extend the life of the buoy, and the surface flotation feature permits retrieval of the device. Recharging battery 40 and recharging air flask 26 serves to place the sonobuoy in condition for reuse.

Thus, there is provided a sonobuoy of the type generally known for defining long virtual vertical arrays, but having facility for effecting a plurality of such arrays and having facility for retrieval and reuse.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A sonobuoy for forming a plurality of virtual vertical arrays, said sonobuoy comprising:

a housing;

hydrophone means mounted on said housing;

transmission means for conveying signals from said sonobuoy to a host platform, said hydrophone means being adapted to transmit through said transmission means to said host platform signals indicative of an acoustic field detected by said hydrophone means, said housing having therein a chamber, said housing having means for receiving water from outside said housing to flood said chamber to cause said sonobuoy to descend with said hydrophone means transmitting said signals to form a first virtual vertical array; and means in said housing for expelling water from said chamber to cause said sonobuoy to rise with said hydrophone means transmitting said signals to form a second virtual vertical array.

2. The sonobuoy in accordance with claim 1 wherein said means for receiving water from outside said housing to flood said chamber comprises an aperture in the wall of said sonobuoy and extending to said chamber.

3. The sonobuoy in accordance with claim 2 and further including a vacuous expandable bladder mounted in said chamber and adapted to expand to substantially fill said chamber.

4. The sonobuoy in accordance with claim 3 wherein said means for expelling water from said chamber further comprises said vacuous bladder, said aperture, and means for expanding said bladder.

5. The sonobuoy in accordance with claim 4 wherein said means for expanding said bladder further comprises an air flask for the retention of compressed air, an air pipe interconnecting said air flask and said bladder, and air valve means in said air pipe for opening and closing said air pipe to open and close communication between said air flask and said chamber.

6. The sonobuoy in accordance with claim 5 and further including a first depth sensor operative upon reaching a preselected deep depth to open said air valve to permit flow of air from said air flask to said bladder, to expand said bladder, to expel water from said chamber, to reduce the weight of said sonobuoy, to cause said sonobuoy to rise.

7. The sonobuoy in accordance with claim 6 and including an exhaust pipe extending from said air pipe to an exhaust opening in the wall of said sonobuoy, and a one-way exhaust valve disposed in said exhaust pipe for opening and closing flow of air from said bladder through said exhaust pipe and said exhaust opening.

8. The sonobuoy in accordance with claim 7 and further including a second depth sensor operative upon reaching a preselected shallow depth to release said exhaust valve to permit flow of air from said bladder outboard of said housing, to permit water to enter said chamber through said hole, to collapse said bladder, to substantially fill said chamber with water, to increase the weight of said sonobuoy, to cause said sonobuoy to fall.

9. The sonobuoy in accordance with claim 7 and including a timer means adapted to delay said release of said exhaust valve, whereby to permit said sonobuoy to float for a selected period of time before said release and said fall of said sonobuoy.

10. The sonobuoy in accordance with claim 5 wherein said bladder is mounted on an end of said air pipe remote from said air flask.

11. A sonobuoy for forming a plurality of virtual vertical arrays, said sonobuoy comprising:

a housing;

hydrophone means mounted on said housing;

a cable attached at one end to said housing and at a second end adapted for attachment to a host platform, said hydrophone means being adapted to signal through said cable to said host platform signals indicative of the acoustic field detected by said hydrophone means, said housing defining therein a chamber, a hole in a wall of said chamber interconnecting the interior of said chamber with the exterior of said housing;

a vacuous substantially collapsible bladder mounted in said chamber and adapted to expand to substantially fill said chamber;

an air flask disposed in said housing;

an air pipe interconnecting said air flask and said bladder;

an air valve disposed in said air pipe for opening and closing communication between said air flask and said bladder;

an air exhaust pipe interconnecting said air pipe and said exterior of said housing;

an exhaust valve in said exhaust pipe; and a first depth sensor mounted on said housing, said air valve being adapted to open in response to preselected deep depth signals from said first depth sensor to permit air from said air flask to enter said bladder to enlarge said bladder in said chamber and expel water therefrom through said hole, said enlargement of said bladder and said expulsion of said water operating to provide buoyancy to said housing and facilitate rising of said housing through an underwater environment.

12. The sonobuoy in accordance with claim 11 and further including a second depth sensor mounted on said housing, said exhaust valve being adapted to be released in response to preselected shallow depth signals from said second depth sensor to permit air from said bladder to exit said housing, and permit water to enter said chamber through said hole, to cause said bladder to substantially collapse upon itself, to decrease buoyancy of said housing and facilitate sinking of said housing through said underwater environment.

* * * * *